US009671733B2

(12) United States Patent
Ebe et al.

(10) Patent No.: US 9,671,733 B2
(45) Date of Patent: Jun. 6, 2017

(54) FIXING DEVICE AND IMAGE FORMING APPARATUS

(71) Applicant: Konica Minolta, Inc., Tokyo (JP)

(72) Inventors: Asahi Ebe, Tokyo (JP); Toshihiro Wazumi, Tokyo (JP); Makoto Ui, Tokyo (JP); Tomoyuki Hayakawa, Tokyo (JP); Akihiko Ooishi, Tokyo (JP)

(73) Assignee: KONICA MINOLTA, INC, Tokyo (JP)

( * ) Notice: Subject to any disclaimer, the term of this patent is extended or adjusted under 35 U.S.C. 154(b) by 27 days.

(21) Appl. No.: 14/034,026

(22) Filed: Sep. 23, 2013

(65) Prior Publication Data

US 2014/0086650 A1 Mar. 27, 2014

(30) Foreign Application Priority Data

Sep. 24, 2012 (JP) ..... 2012-209852

(51) Int. Cl.
*G03G 15/20* (2006.01)

(52) U.S. Cl.
CPC ..... *G03G 15/2085* (2013.01); *G03G 15/2028* (2013.01); *G03G 15/2053* (2013.01); *G03G 15/20* (2013.01); *G03G 2215/2032* (2013.01)

(58) Field of Classification Search
CPC . G03G 15/20; G03G 15/2053; G03G 15/2064
USPC ..... 399/122, 328, 329
See application file for complete search history.

(56) References Cited

U.S. PATENT DOCUMENTS

| | | | | |
|---|---|---|---|---|
| 5,450,181 | A * | 9/1995 | Tsukida et al. | 399/322 |
| 7,570,910 | B2 | 8/2009 | Ishii | |
| 7,693,471 | B2 * | 4/2010 | Kikuchi et al. | 399/323 |
| 2006/0285893 | A1 | 12/2006 | Ishii | |
| 2012/0321360 | A1 * | 12/2012 | Futamata et al. | 399/329 |
| 2013/0251419 | A1 * | 9/2013 | Kimura et al. | 399/329 |

FOREIGN PATENT DOCUMENTS

| | | | |
|---|---|---|---|
| JP | 10-307493 | A | 11/1998 |
| JP | 2003-263047 | A | 9/2003 |
| JP | 2004-279492 | A | 10/2004 |

(Continued)

OTHER PUBLICATIONS

Garvin Tam; Glenn Elert, Coefficients of Friction for Teflon, 2004.*

(Continued)

*Primary Examiner* — David Gray
*Assistant Examiner* — Michael Harrison
(74) *Attorney, Agent, or Firm* — Cantor Colburn LLP

(57) ABSTRACT

A fixing device and An image forming apparatus include: a first pressure roller having an elastic layer in a surface layer section; a fixing belt wound on the elastic layer of the first pressure roller; a second pressure roller that presses the elastic layer of the first pressure roller via the fixing belt, the second pressure roller forming a fixing nip portion between the fixing belt and the second pressure roller; and a guide member that guides the fixing belt in such a manner as to separate the fixing belt from a protruding portion of the elastic layer, the protruding portion being formed on an entrance side of the fixing nip portion in a sheet conveying direction.

8 Claims, 7 Drawing Sheets

(56) References Cited

FOREIGN PATENT DOCUMENTS

| | | | |
|---|---|---|---|
| JP | 2004-361797 | A | 12/2004 |
| JP | 2005-250043 | A | 9/2005 |
| JP | 2005-338594 | A | 12/2005 |
| JP | 2008225173 | A | 9/2008 |
| JP | 4821594 | B2 | 9/2011 |
| JP | 4841179 | B2 | 10/2011 |

OTHER PUBLICATIONS

Japanese Decision of Rejection corresponding to Japanese Patent Application No. 2012-209852; Dispatch Date, Dec. 24, 2014; with English translation.
Notice of Reasons for Rejection for Japanese Patent Application No. 2012-209852, dispatch date Oct. 21, 2014, with English translation.
Extended European Search Report corresponding to Application No. 13185098.4-1568/2711780; Dated: Mar. 29, 2016.

* cited by examiner

| POSITION OF TENSION ROLLER | a | b | c | d | e | f | g | h | i | j | k |
|---|---|---|---|---|---|---|---|---|---|---|---|
| ANGLE OF TENSION ROLLER | SMALLER THAN 40 DEGREES | | | 40 TO 90 DEGREES | | | | | EQUAL TO OR GREATER THAN 90 DEGREES | | |
| | 20 | 30 | 35 | 40 | 50 | 60 | 70 | 80 | 95 | 105 | 110 |
| FORMATION OF WAVY WRINKLES | C | C | C | B | A | A | A | A | – | – | – |

FIG. 4

| POSITION OF TENSION ROLLER | | a | b | c | d | e |
|---|---|---|---|---|---|---|
| ANGLE OF TENSION ROLLER | | SMALLER THAN 40 DEGREES | | 40 TO 90 DEGREES | | |
| | | 30 | 35 | 45 | 60 | 80 |
| CROWN AMOUNT $\Delta\phi$ [mm] | 0.5 | C | C | C | B | B |
| | 0.3 | C | C | C | B | A |
| | 0 | C | C | B | A | A |
| | −0.3 | C | C | A | A | A |
| | −0.5 | C | C | A | A | A |

FIG. 6

FIXING DEVICE AND IMAGE FORMING APPARATUS

CROSS REFERENCE TO RELATED APPLICATIONS

This application is entitled and claims the benefit of Japanese Patent Application No. 2012-209852, filed on Sep. 24, 2012, the disclosure of which including the specification, drawings and abstract is incorporated herein by reference in its entirety.

BACKGROUND OF THE INVENTION

Field of the Invention

The present invention relates to a fixing device and an image forming apparatus.

Description of Related Art

A fixing device is provided in an image forming apparatuses such as a printer, a copier, a facsimile machine and a multifunctional peripheral including these apparatuses. A fixing device fixes a toner image which has been formed on a recording sheet based on input image data. In a fixing device, a recording sheet on which a toner image has been formed is pressed and heated when the sheet passes through a fixing nip portion formed between a heating member (for example, a fixing roller and a fixing belt) and a pressing member (for example, a pressure roller), and thus a toner image is fixed on the recording sheet.

Conventionally, there has been a problem that image quality and sheet feeding performance are degraded by factors, which are caused at the time of the fixing, such as an offset in which toner adheres to the surface of the fixing roller, and winding in which a recording sheet on which a toner image has been formed winds around the fixing roller. To solve such a problem, a technique has been proposed in which a wax-added toner is used so that wax eluted from toner dissolved at the time of heating is supplied to the fixing roller, and thus the offset and the winding of the recording sheet are suppressed.

However, in the case where part of the wax supplied to the fixing roller from the toner adheres to the fixing roller and a latent image due to the wax is formed on the fixing roller, the amount of the wax existing on the image surface varies at the time of the next fixing. As a result, there has been a problem that a phenomenon such as uneven gloss (hereinafter referred to also as "gloss memory") which occurs due to the latent image on the fixing roller, thus degrading image quality. In order to prevent the gloss memory from occurring, it has been necessary to increase a pressing load at the fixing nip portion, in other words, a pressing load between the fixing roller and the pressure roller, by, for example, about 1.5 times as compared to a conventional pressing load.

It is to be noted that, as a technique relating to a fixing device, a technique is proposed in which an induction heating section is displaced in association with displacement of a heat generation member in a fixing device of an electromagnetic induction heating type (see, for example, Japanese Patent No. 4841179). According to the technology disclosed in Japanese Patent No. 4841179, even when components of the fixing device are thermally deformed, variation in the positional relationship between the induction heating section and the heat generation member is small, and thus defects such as variation in heat generation efficiency can be suppressed.

In addition, a technique is proposed in which the posture of a recording sheet being advanced to a pressing zone is changed to a favorable posture according to the basis weight of the recording sheet, thereby suppressing formation of dents and scars on a resin layer on the surface of a fixing member (see, for example, Japanese Patent No. 4821594).

However, there is a problem that, when a great pressing load is exerted by the heating member and the pressing member in order to prevent the uneven gloss from occurring, waves 20 (hereinafter referred to as "wavy wrinkles") are formed along the conveying direction on recording sheet 10 as illustrated in FIG. 7A as a side effect.

Wavy wrinkles 20 are considered to be formed by the following mechanism. FIG. 7B illustrates a configuration of a fixing device. The fixing device includes a heating roller (not shown), fixing roller 40, endless fixing belt 50, and pressure roller 60. Fixing roller 40 includes elastic layer (for example, a rubber layer) 30. The heating roller and fixing roller 40 are spaced a predetermined distance apart from each other. Fixing belt 50 is provided around the heating roller and fixing roller 40. The pressure roller 60 is disposed in a state where it is in pressure contact with the fixing belt 50 in a region where the fixing belt 50 and fixing roller 40 are in contact with each other. Fixing nip portion 70 having an upwardly-raised form is formed at a part where the fixing belt 50 and pressure roller 60 make contact with each other.

In fixing nip portion 70, pressure roller 60 presses elastic layer 30 of fixing roller 40 to dent elastic layer 30. At a portion around an end portion of fixing nip portion 70 on the entrance side, portion 80 (hereinafter referred to also as "bulging portion") where deflection of elastic layer 30 caused by the pressure contact of pressure roller 60 has a downwardly-raised form is formed. Along with the rotation of fixing roller 40 and pressure roller 60, bulging portion 80 of elastic layer 30 expandingly and contractingly deforms in an axial direction of fixing roller 40. As a result, in fixing belt 50, a portion in contact with bulging portion 80 of elastic layer 30 is slightly undulated, and thus wavy wrinkles 20 are formed on recording sheet 10 which has passed through fixing nip portion 70 as being sandwiched between fixing belt 50 and pressure roller 60.

SUMMARY OF THE INVENTION

It is an object of the present invention to provide a fixing device and an image forming apparatus which can prevent wavy wrinkles from occurring even when the pressing load at a fixing nip portion is great.

In order to achieve the object, a fixing device reflecting one aspect of the present invention includes: a first pressure roller having an elastic layer in a surface layer section; a fixing belt wound on the elastic layer of the first pressure roller; a second pressure roller that presses the elastic layer of the first pressure roller via the fixing belt, the second pressure roller forming a fixing nip portion between the fixing belt and the second pressure roller; and a guide member that guides the fixing belt in such a manner as to separate the fixing belt from a protruding portion of the elastic layer, the protruding portion being formed on an entrance side of the fixing nip portion in a sheet conveying direction.

Preferably, in the above-mentioned fixing device, the guide member is located at a position between a second straight line and a third straight line, the second and third straight lines being obtained by inclining a first straight line to a sheet entering side about an end point at 40 degrees and 90 degrees, respectively, the end point being located on an upstream side of the fixing nip portion in a rotational direction of the fixing belt, and the first straight line passing through the end point and being in parallel to a straight line connecting a center of the first pressure roller and a center of the second pressure roller.

Preferably, in the above-mentioned fixing device, the guide member has in an axial direction thereof an inverted crown form in which a diameter of end portions is greater than a diameter of a center portion.

Preferably, in the above-mentioned fixing device, the guide member is rotated by a rotation of the fixing belt.

Preferably, in the above-mentioned fixing device, a coefficient of a static friction at a surface layer of the guide member is 0.4 or lower.

Preferably, in the above-mentioned fixing device, the surface layer of the guide member has a coating of a perfluoroalkoxy resin, Teflon, a fluorine resin, or a polytetrafluoro ethylene resin.

An image forming apparatus reflecting another aspect of the present invention includes: a first pressure roller having an elastic layer in a surface layer section; a fixing belt wound on the elastic layer of the first pressure roller; a second pressure roller that presses the elastic layer of the first pressure roller via the fixing belt, the second pressure roller forming a fixing nip portion between the fixing belt and the second pressure roller; and a guide member that guides the fixing belt in such a manner as to separate the fixing belt from a protruding portion of the elastic layer, the protruding portion being formed on an entrance side of the fixing nip portion in a sheet conveying direction.

Preferably, in the above-mentioned image forming apparatus, the guide member is located at a position between a second straight line and a third straight line, the second and third straight lines being obtained by inclining a first straight line to a sheet entering side about an end point at 40 degrees and 90 degrees, respectively, the end point being located on an upstream side of the fixing nip portion in a rotational direction of the fixing belt, and the first straight line passing through the end point and being in parallel to a straight line connecting a center of the first pressure roller and a center of the second pressure roller.

Preferably, in the above-mentioned image forming apparatus, the guide member has in an axial direction thereof an inverted crown form in which a diameter of end portions is greater than a diameter of a center portion.

Preferably, in the above-mentioned image forming apparatus, the guide member is rotated by a rotation of the fixing belt.

Preferably, in the above-mentioned image forming apparatus, a coefficient of a static friction at a surface layer of the guide member is 0.4 or lower.

Preferably, in the above-mentioned image forming apparatus, the surface layer of the guide member has a coating of a perfluoroalkoxy resin, Teflon, a fluorine resin, or a polytetrafluoroethylene resin.

BRIEF DESCRIPTION OF DRAWINGS

The present invention will become more fully understood from the detailed description given hereinbelow and the appended drawings which are given by way of illustration only, and thus are not intended as a definition of the limits of the present invention, and wherein:

FIG. 4 is a table showing relationships between a position of a tension roller and formation of wavy wrinkles in the first example;

FIG. 6 is a table showing relationships between forms and positions of the tension roller, and formation of wavy wrinkles in the second example;

DESCRIPTION OF THE PREFERRED EMBODIMENTS

In the following, the present embodiment is described in detail with reference to the drawings.

[Configuration of Image Forming Apparatus 100]

Figure 1:
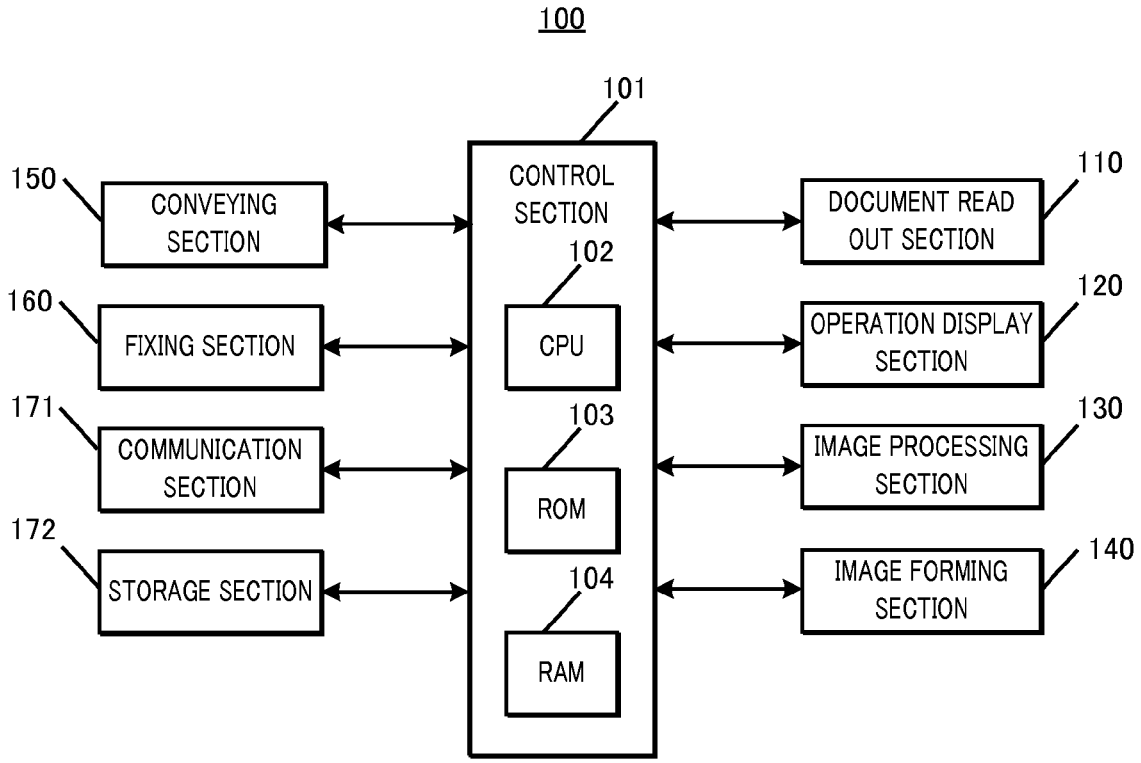
FIG. 1 is a control block diagram of an image forming apparatus of the present embodiment.

Image forming apparatus 100 illustrated in FIG. 1 forms an image on a recording sheet by the electrophotographic process. Image forming apparatus 100 includes control section 101, document read out section 110, operation display section 120, image processing section 130, image forming section 140, conveying section 150, fixing section 160, communication section 171, and storage section 172.

Control section 101 includes central processing unit (CPU) 102, read only memory (ROM) 103, random access memory (RAM) 104, and the like. CPU102 reads out a program corresponding to processing details from ROM103, loads the program in RAM 104, and performs a centralized control of operations of the blocks of image forming apparatus 100 in conjunction with the loaded program. At this time, various kinds of data stored in storage section 172 are referenced. Storage section 172 is composed of a nonvolatile-semiconductor memory (so-called flash memory) or a hard disk drive, for example.

Control section 101 exchanges various kinds of data, via communication section 171, with an external apparatus (for example, a personal computer) connected through a communication network such as local area network (LAN) and wide area network (WAN). For example, control section 101 receives image data (input image data) sent from the external apparatus, and forms an image on a recording sheet based on the received image data. Communication section 171 is composed of a communication control card such as a LAN card, for example.

Document read out section 110 optically scans a document having been conveyed onto a contact glass and brings light reflected from a document into an image on a light reception surface of charge coupled device (CCD) sensor, thereby reading out the image of the document. It is to be noted that, while the document is conveyed onto the contact glass by an automatic document sheet feeder (ADF), the document may also be manually placed on the contact glass.

Operation display section 120 includes a touch screen. Users can perform inputting operation for various kinds of instructions and settings from the touch screen.

Image processing section 130 includes a circuit for performing analog-to-digital (A/D) conversion processing and a circuit for performing digital image processing. Image processing section 130 performs A/D conversion processing on an analog image signal acquired by a CCD sensor of document read out section 110 to generate digital image data, and outputs the generated digital image data to image forming section 140.

Image forming section 140 emits laser light based on the digital image data generated by image processing section 130, and applies the emitted laser light on a photoconductor drum to form an electrostatic latent image on the photoconductor drum (light exposure step).

Image forming section 140 includes configurations for carrying out steps including, in addition to the above-mentioned light exposure step, a charging step that is performed prior to the light exposure step, a development step that is performed after the light exposure step, a transferring step subsequent to the development step, and a cleaning step subsequent to the transferring step.

In the charging step, image forming section 140 uses corona discharging from a charging device to uniformly charge the surface of the photoconductor drum. In the development step, image forming section 140 causes toner contained in a developer in a developing device to adhere to an electrostatic latent image on the photoconductor drum, and thus forms a toner image on the photoconductor drum.

In the transferring step, image forming section 140 primary-transfers the toner image formed on the photoconductor drum to an intermediate transfer belt. In addition, image forming section 140 secondary-transfers the toner image formed on the intermediate transfer belt to a recording sheet conveyed by conveying section 150. In the cleaning step, image forming section 140 removes toner remaining on the photoconductor drum after the transferring step.

Fixing section 160 applies heat and pressure to a toner image on a recording sheet introduced in the fixing nip portion (thermal fixing), thereby fixing the toner image to the recording sheet (fixing step). As a result, a fixed toner image is formed on the recording sheet. The recording sheet having been subjected to the thermal fixation by fixing section 160 is ejected out of image forming apparatus 100.

[Configuration for Forming Fixing Nip Portion 200]

Next, with reference to FIG. 2, a configuration for forming fixing nip portion 200 will be described. Fixing section 160 is of a belt heating type. Specifically, fixing section 160 includes an upper pressing section and a lower pressing section which form fixing nip portion 200. Upper pressing section includes heating roller 210 and fixing roller 220 that serves as a first pressure roller. Endless fixing belt 230 is wound around heating roller 210 and fixing roller 220, at a predetermined belt tensile force (for example, 400 [N]). Lower pressing section includes pressure roller 240 serving as a second pressure roller. Pressure roller 240 presses fixing roller 220 at a predetermined fixing load (for example, 2650 [N]) via fixing belt 230. In this manner, upwardly-raised fixing nip portion 200 through which recording sheet S is conveyed as being sandwiched therebetween is formed between fixing roller 220 and pressure roller 240.

Fixing belt 230 makes contact with recording sheet S on which a toner image has been formed, and heats recording sheet S at a temperature for fixing (for example, 160 to 200 [° C.]). Here, the temperature for fixing is a temperature which can offer a quantity of heat required for melting the toner on recording sheet S. The temperature for fixing differs depending on factors such as types of recording sheet S on which an image is to be formed.

For fixing belt 230, for example, a PI (polyimide) resin having a thickness of 70 [μm] is used as a base, and the outer peripheral surface of the base is covered with a heat-resistant silicon rubber (JIS-A hardness:) 30° having a thickness of 200 [μm] as an elastic layer. Further, the surface layer has a coating of a PFA (perfluoro alkoxy) resin, which is a heat-resistant resin, having a thickness of 30 [μm].

Fixing belt 230 rotates in the arrow A direction (hereinafter referred to as "rotational direction"). The linear velocity of fixing belt 230 is 460 [mm/s], for example.

Heating roller 210 incorporates therein halogen heaters 250 serving as heaters for heating fixing belt 230. In each halogen heater 250, for example, the outer surface of a cylindrical mandrel made of aluminum or the like having a thickness of 4 [mm] is covered by a coating resin layer made of a PTFE resin having a thickness of 30 [μm]. Heating roller 210 has an outer diameter of 58 [mm], for example. It is to be noted that, in order to deal with various sheet widths, for example, halogen heaters 250 include two 1200 [W] halogen heaters, two 750 [W] halogen heaters, and one 500 [W] halogen heater, and the heaters are disposed in such as manner as to obtain various distributions of heat in the axial direction which correspond to various widths of sheet S.

The temperature of halogen heaters 250 is controlled by control section 101. Halogen heaters 250 heat heating roller 210, and as a result, fixing belt 230 is heated.

Together with pressure roller 240, fixing roller 220 configures a pressing section for forming fixing nip portion 200. Fixing roller 220 is driven and controlled (for example, turn on/off of rotation, control of rotating speed, and the like) by control section 101.

For fixing roller 220, for example, solid mandrel **220*a* made of a metal such as iron is covered by heat-resistant silicon rubber 220*b* (JIS-A hardness: 5 [°]) which has a thickness of 20 [mm] and serves as an elastic layer of a surface layer section, and further, covered by a coating resin layer made of a PTFE resin, which is a low-friction and heat-resistant resin, having a thickness of 30 [μm]. Fixing roller 220 has a hardness of 35 [°] in ASKER-C hardness. Fixing roller 220** has an outer diameter of 70 [mm] for example.

By pressing means (not illustrated), pressure roller 240 is brought into pressure contact with silicone rubber **220*b* of fixing roller 220 via fixing belt 230. Pressure roller 240 is driven and controlled (for example, turn on/off of rotation, control of rotating speed, and the like) by control section 101**.

For pressure roller 240, the outer peripheral surface of a cylindrical mandrel made of aluminum or the like having a thickness of 4 [mm] is covered by a heat-resistant silicon rubber (JIS-A hardness: 30 [°]) which has a thickness of 1 [mm] and serves as an elastic layer, and further, covered by a resin layer of a PFA tube having a thickness of 30 [μm]. Pressure roller 240 has an outer diameter of 70 [mm] for example. The control temperature of pressure roller 240 is 80 to 120 [° C.] for example.

Tension roller 260 (guide member) that stretches fixing belt 230 is provided on the inner peripheral surface side of fixing belt 230, and on the upstream side in the rotational direction of fixing nip portion 200. Tension roller 260 is rotated by the rotation of fixing belt 230. Tension roller 260 has an outer diameter of 15 [mm] for example.

Tension roller 260 guides fixing belt 230 so as to separate fixing belt 230 from bulging portion 270. Here, bulging portion 270 is a protruding portion which is part of silicon rubber **220*b* of fixing roller 220 on the entrance side of fixing nip portion 200 in the sheet conveying direction and is formed by the pressure contact of pressure roller 240, that is, a portion where deflection caused by the pressure contact has a downwardly-raised form. Specifically, tension roller 260 is provided at a position at which the winding amount of fixing belt 230 at bulging portion 270 is smaller compared with a case where no tension roller 260** is provided.

In the present embodiment, tension roller 260 is disposed at a position between straight line L3 (second straight line) and straight line L4 (third straight line) which are obtained by inclining straight line L2 (first straight line) to the sheet entering side about end point 300 at 40 degrees and 90 degrees, respectively. End point 300 is located on the upstream side of fixing nip portion 200 in the rotational direction of fixing belt 230. Straight line L2 passes through end point 300 and is in parallel to straight line L1 which connects center 280 of fixing roller 220 and center 290 of pressure roller 240.

Effect of the Present Embodiment

As has been described in detail, in the present embodiment, there are provided fixing roller 220 including silicon rubber 220*b* in the surface layer section, fixing belt 230 wound on the elastic layer of fixing roller 220, and pressure roller 240 that presses silicon rubber 220*b* of fixing roller 220 via fixing belt 230 and forms fixing nip portion 200 between fixing belt 230 and pressure roller 240 itself. There is provided tension roller 260 that guides fixing belt 230 in such a manner as to separate fixing belt 230 from bulging portion 270 of silicon rubber 220*b* formed on the entrance side of fixing nip portion 200 in the sheet conveying direction.

With the above-mentioned configuration of the present embodiment, even when the pressing load at the fixing nip portion 200 is increased and bulging portion 270 is expandingly and contractingly deformed in the axial direction of fixing roller 220, undulation is less likely to be formed on fixing belt 230 (adverse effect of bulging portion 270 is less likely to be received) as much as the winding amount of fixing belt 230 at bulging portion 270 is decreased, and thus, it is possible to prevent wavy wrinkles from being formed on recording sheet S which has been passed through fixing nip portion 200 as being sandwiched between fixing belt 230 and pressure roller 240.

In addition, in the present embodiment, tension roller 260 is rotated by the rotation of fixing belt 230. With such a configuration, the load exerted to fixing belt 230 by tension roller 260 is decreased, and thus the durability of fixing belt 230 can be improved.

[Modification]

While an exemplary case where tension roller 260 is rotated by the rotation of fixing belt 230 has been described in the above-mentioned embodiment, the present invention is not limited to the above-mentioned embodiment. For example, tension roller 260 may also be driven to rotate under the control of control section 101. In addition, tension roller 260 may also be non-rotatably fixed.

In addition, while an exemplary case where tension roller 260 functions as a guide member has been described in the above-mentioned embodiment, the present invention is not limited to the above-mentioned embodiment. It suffices that the guide member guides fixing belt 230 in such a manner as to separate fixing belt 230 from bulging portion 270 of silicon rubber 220*b*. The form of the guide member is not limited to the columnar form (roller form) of the above-mentioned embodiment, as long as the guide member has a curved plane at least in the range where the guide member makes contact with the inner peripheral surface of fixing belt 230.

In addition, in the above-mentioned embodiment, for the purpose of reducing the load exerted to fixing belt 230 by tension roller 260, the surface layer of tension roller 260 may also has a coating of a PFA resin, Teflon (registered trademark), a fluorine resin or a PTFE resin, and it is desirable that the surface layer has a coefficient of static friction of 0.4 or lower, for example.

Figure 3:
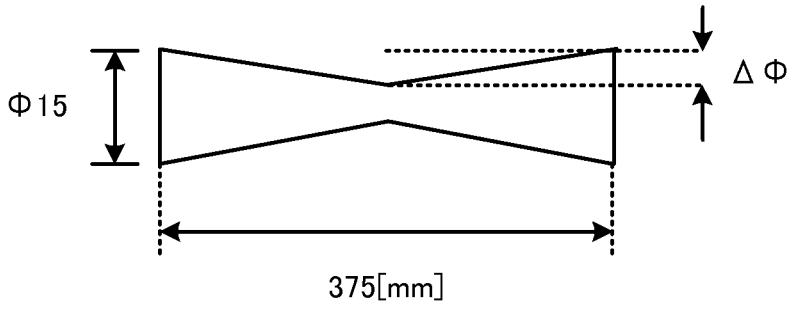
FIG. 3 illustrates a modification of a configuration of a tension roller.

In addition, in the above-mentioned embodiment, tension roller 260 may have an inverted crown form (V-form) in which the diameter of end portions is greater than that of the center portion in its axial direction, as illustrated in FIG. 3. Here, regarding the size of the inverted crown form of tension roller 260, the diameter of the end portions is 15 [mm], the diameter of the center portion is 14.5 [mm], and the crown amount $\Delta\phi$ is −0.5 [mm], for example.

It should be understood by those skilled in the art that various modifications, combinations, sub-combinations and alterations may occur depending on design requirements and other factors in so far as they are within the scope of the appended claims or the equivalents thereof.

EXAMPLES

Finally, results of experiments performed by the present inventor for confirming the effectiveness of the above-mentioned embodiment will be described.

[Configuration of Image Forming Apparatus According to First Example]

Figure 2:
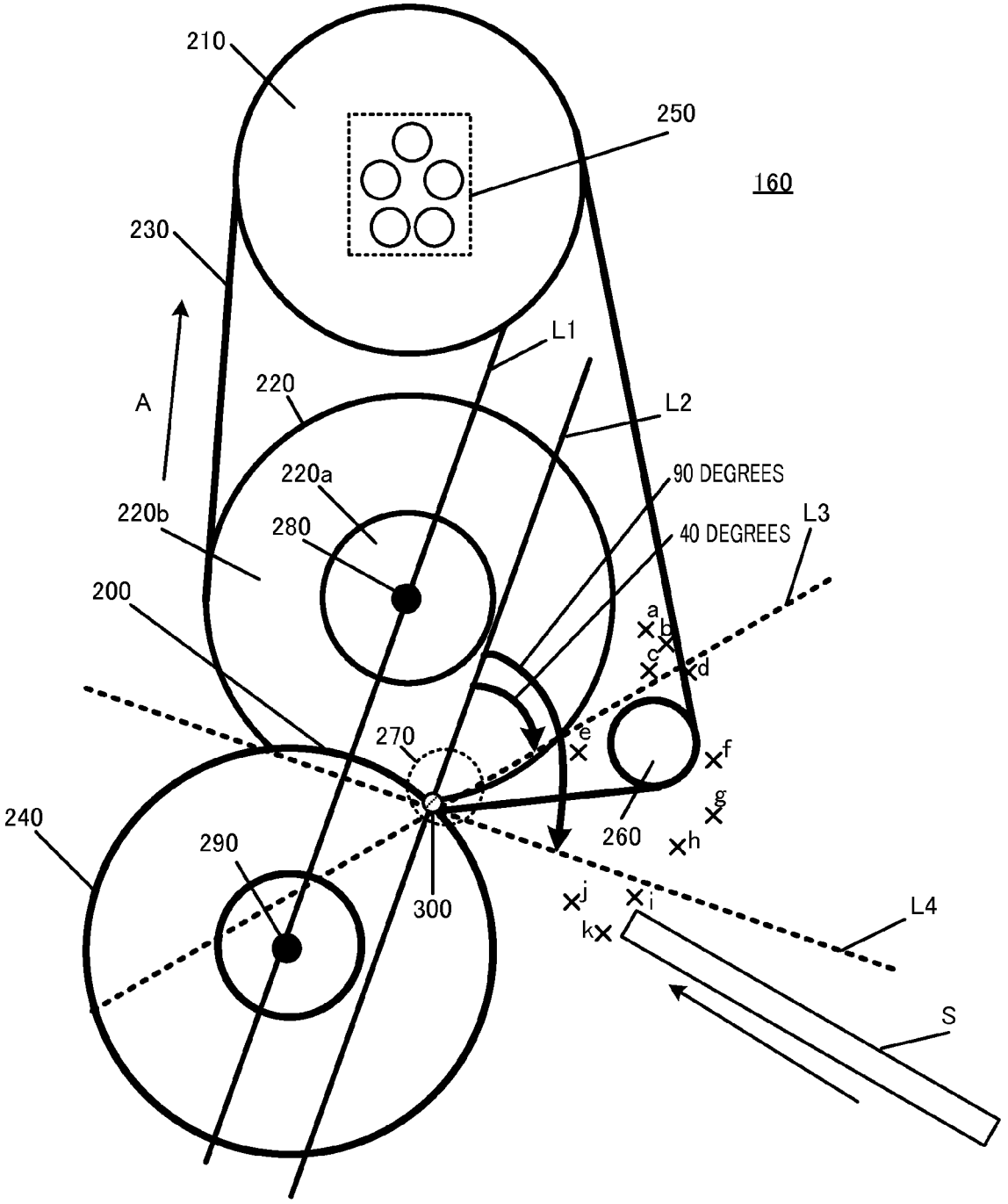
FIG. 2 illustrates a configuration for forming a fixing nip portion of the present embodiment.

As an image forming apparatus for the experiment, image forming apparatus 100 having the configuration shown in FIGS. 1 and 2 was used.

[Configuration of Image Forming Apparatus According to Second Example]

As an image forming apparatus for the experiment, image forming apparatus 100 having the configuration shown in FIGS. 1 and 2 was used. In the second example, tension roller 260 has a crown form.

[First Experimental Method]

In the first experiment, tension roller 260 is disposed at each of points a to k illustrated in FIG. 2, and the formation of wavy wrinkles on recording sheet S which has been passed through fixing nip portion 200 is visually confirmed for each of the points. FIG. 4 shows the results of an assessment of the formation of wavy wrinkles based on the following criteria. It is to be noted that "angle of tension roller" in FIG. 4 means the inclination angle of straight line L2 at which tension roller 260 (one of the points a to k) is positioned on the inclined straight line. Here, straight line L2 is inclined about end point 300 to the sheet entering side. For example, when tension roller 260 is positioned at the point e, the point e is positioned on a straight line which is obtained by inclining straight line L2 at 50 degrees to the sheet entering side about end point 300.

(Formation of Wavy Wrinkles)

A: No wavy wrinkles were confirmed, favorable.

B: A few wavy wrinkles were confirmed, allowable.

C: Wavy wrinkles were clearly confirmed, unfavorable from practical perspective.

[Results of First Experiment]

In the first experiment, when the tension roller angle was smaller than 40 degrees, wavy wrinkles were significantly formed. Meanwhile, when the tension roller angle was equal to or greater than 40 degrees, the degree of formation of wavy wrinkles was greatly improved and a high-quality image was obtained. However, when the tension roller angle was equal to or greater than 90 degrees, recording sheet S made contact with fixing belt 230 before entering fixing nip portion 200, and the image could not be put through the nip portion. It can be understood from the above-mentioned results that the formation of wavy wrinkles depends on the position of tension roller 260, and tension roller 260 is desirably disposed at a position between straight lines L3 and L4 which are obtained by inclining straight line L2 to the sheet entering side about end point 300 at 40 degrees and 90 degrees, respectively.

[Second Experimental Method]

Figure 5:
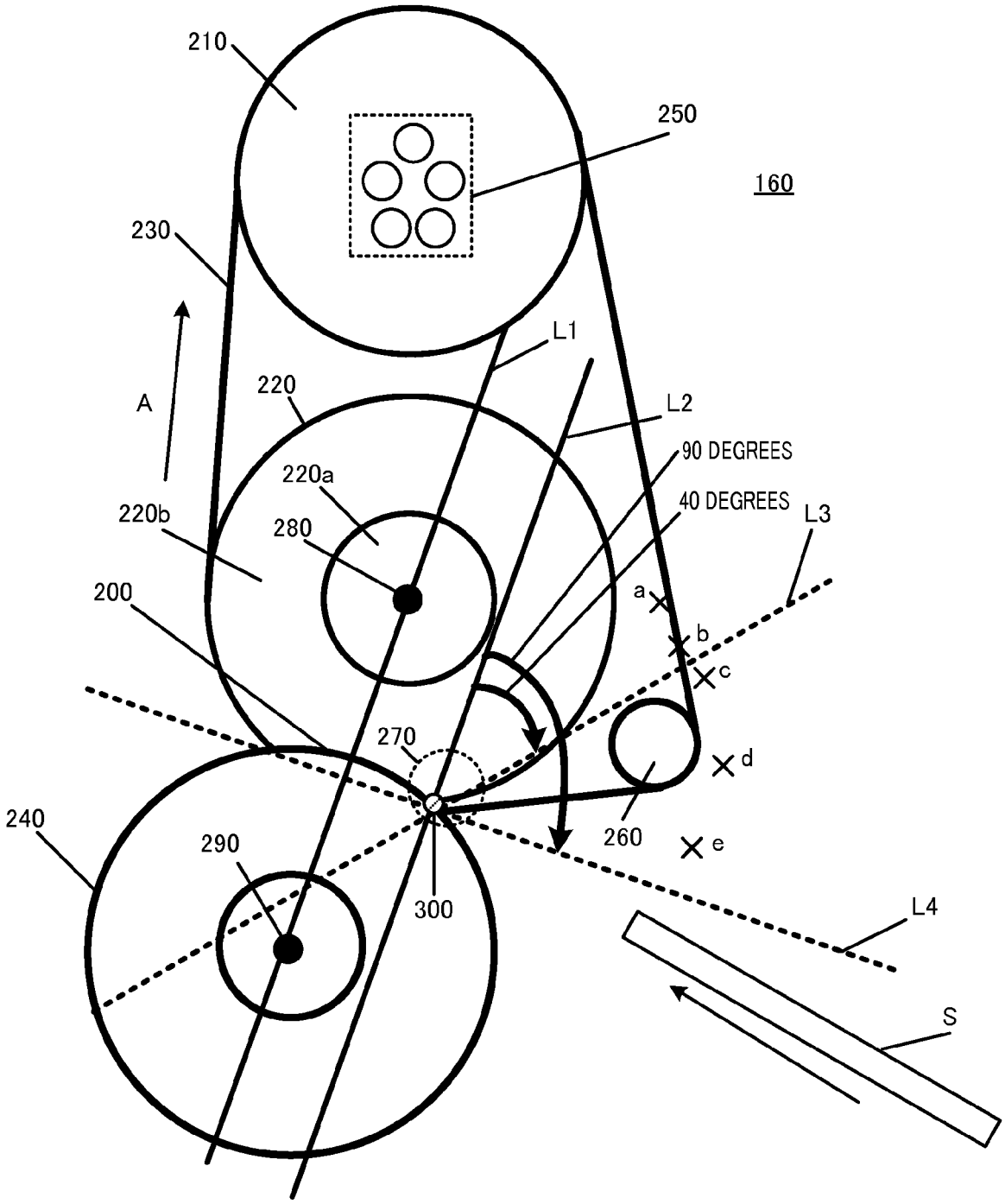
FIG. 5 illustrates a configuration for forming a fixing nip portion in the second example.
Figure 7A:
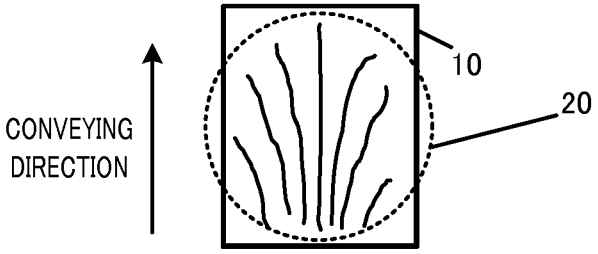
FIG. 7A illustrates a problem of a conventional technology.
Figure 7B:
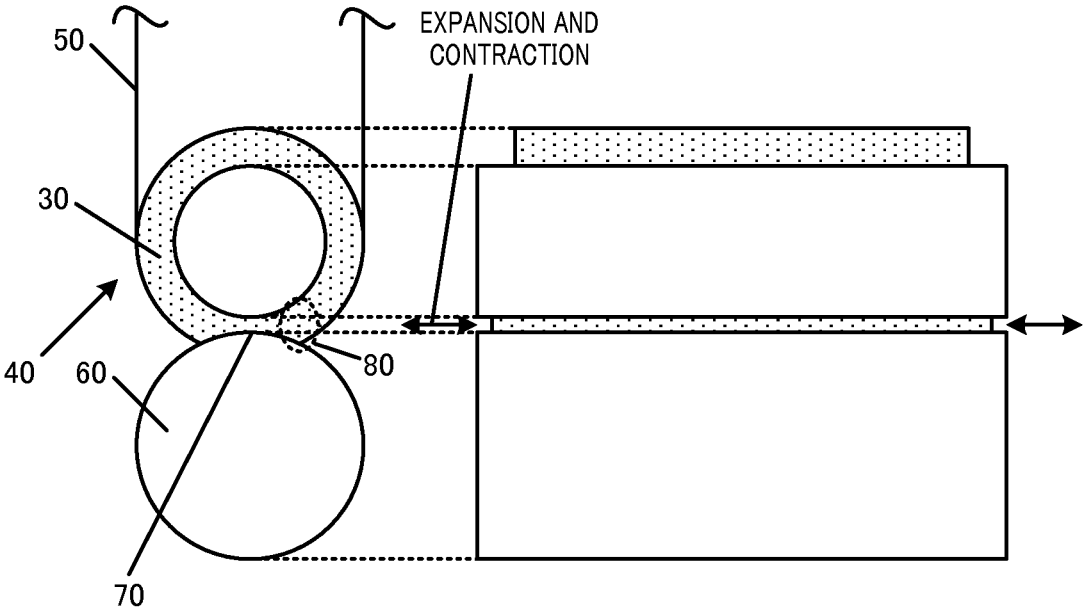
FIG. 7B illustrates a problem of a conventional technology.

In the second experiment, tension roller 260 was disposed at each of points a to e illustrated in FIG. 5, and the form of tension roller 260 was varied, and the formation of wavy wrinkles on recording sheet S which has been passed through fixing nip portion 200 was visually confirmed for each of the points. FIG. 6 shows the results of an assessment of the formation of wavy wrinkles on the basis of the following criteria.

(Formation of Wavy Wrinkles)

A: No wavy wrinkles were confirmed, favorable.

B: A few wavy wrinkles were confirmed, allowable.

C: Wavy wrinkles were clearly confirmed, unfavorable from practical perspective.

[Results of Second Experiment]

In the second experiment, when tension roller 260 has a crown form in which the diameter of end portions is smaller than that of the center portion in its axial direction, the degree of formation of wavy wrinkles was worsened, whereas when tension roller 260 has an inverted crown form in which the diameter of the end portions is greater than that of the center portion in the axial direction, the degree of formation of wavy wrinkles was improved (particularly when the tension roller angle is 45 degrees and the crown amount is −0.3 or greater). Given the above-mentioned results, tension roller 260 desirably has an inverted crown form.

What is claimed is:

1. A fixing device comprising:

a first pressure roller having an elastic layer in a surface layer section;

a fixing belt wound on the elastic layer of the first pressure roller;

a second pressure roller that presses the elastic layer of the first pressure roller via the fixing belt, the second pressure roller forming a fixing nip portion through which a recording sheet is conveyed as being held between the fixing belt and the second pressure roller; and a guide member that guides the fixing belt in such a manner as to separate the fixing belt from a protruding portion of the elastic layer, the protruding portion being formed on an entrance side of the fixing nip portion in a sheet conveying direction;

wherein the guide member is located at a position between a second straight line and a third straight line, the second and third straight lines being obtained by inclining a first straight line to a sheet entering side about an end point at 40 degrees and 90 degrees, respectively, the end point being located on an upstream side of the fixing nip portion in a rotational direction of the fixing belt, and the first straight line passing through the end point and being in parallel to a straight line connecting a center of the first pressure roller and a center of the second pressure roller, and the recording sheet is conveyed in the fixing nip portion from a side of the second pressure roller lower than the third straight line.

2. The fixing device according to claim 1, wherein the guide member has in an axial direction thereof an inverted crown form in which a diameter of end portions is greater than a diameter of a center portion.

3. The fixing device according to claim 1, wherein the guide member is rotated by a rotation of the fixing belt.

4. The fixing device according to claim 1, wherein the surface layer of the guide member has a coating of a perfluoroalkoxy resin, Teflon, a fluorine resin, or a polytetrafluoroethylene resin.

5. An image forming apparatus comprising:

a first pressure roller having an elastic layer in a surface layer section;

a fixing belt wound on the elastic layer of the first pressure roller;

a second pressure roller that presses the elastic layer of the first pressure roller via the fixing belt, the second pressure roller forming a fixing nip portion through which a recording sheet is conveyed as being held between the fixing belt and the second pressure roller; and a guide member that guides the fixing belt in such a manner as to separate the fixing belt from a protruding portion of the elastic layer, the protruding portion being formed on an entrance side of the fixing nip portion in a sheet conveying direction;

wherein the guide member is located at a position between a second straight line and a third straight line, the second and third straight lines being obtained by inclining a first straight line to a sheet entering side about an end point at 40 degrees and 90 degrees, respectively, the end point being located on an upstream side of the fixing nip portion in a rotational direction of the fixing belt, and the first straight line passing through the end point and being in parallel to a straight line connecting a center of the first pressure roller and a center of the second pressure roller, and the recording sheet is conveyed in the fixing nip portion from a side of the second pressure roller lower than the third straight line.

6. The image forming apparatus according to claim 5, wherein the guide member has in an axial direction thereof an inverted crown form in which a diameter of end portions is greater than a diameter of a center portion.

7. The image forming apparatus according to claim 5, wherein the guide member is rotated by a rotation of the fixing belt.

8. The image forming apparatus according to claim 5, wherein the surface layer of the guide member has a coating of a perfluoroalkoxy resin, Teflon, a fluorine resin, or a polytetrafluoroethylene resin.

* * * * *